US009074819B2

(12) United States Patent
Tiras et al.

(10) Patent No.: US 9,074,819 B2
(45) Date of Patent: Jul. 7, 2015

(54) HIGH VELOCITY FLUID FLOW ELECTRIC HEATER

(75) Inventors: Craig S. Tiras, Houston, TX (US); David Griffith, Cypress, TX (US)

(73) Assignee: Gaumer Company, Inc., Houston, TX (US)

( * ) Notice: Subject to any disclaimer, the term of this patent is extended or adjusted under 35 U.S.C. 154(b) by 732 days.

(21) Appl. No.: 13/439,543

(22) Filed: Apr. 4, 2012

(65) Prior Publication Data

US 2013/0264326 A1 Oct. 10, 2013

(51) Int. Cl.
*F27D 11/00* (2006.01)
*F27D 11/02* (2006.01)

(52) U.S. Cl.
CPC ..... *F27D 11/02* (2013.01)

(58) Field of Classification Search
CPC ..... F24H 1/101; F24H 1/142; F24H 1/102
USPC ..... 392/485, 486, 487, 488, 490, 520, 528, 392/552, 553, 538, 534, 523
See application file for complete search history.

(56) References Cited

U.S. PATENT DOCUMENTS 1,355,838 A * 10/1920 McLean ..... 392/479
1,449,406 A * 3/1923 Householder ..... 392/489
2,649,532 A * 8/1953 Woodman ..... 392/457
2,908,793 A * 10/1959 Aloi ..... 219/241
3,229,358 A * 1/1966 Scadron et al. ..... 29/615
3,546,431 A * 12/1970 Gibbs ..... 392/503
3,582,968 A * 6/1971 Buiting et al. ..... 392/478
3,694,626 A * 9/1972 Harnden, Jr. ..... 219/541
3,719,799 A * 3/1973 Takayasu ..... 219/523
4,233,494 A * 11/1980 Pawlik et al. ..... 392/488
4,305,547 A * 12/1981 Cohen ..... 236/18
4,334,141 A * 6/1982 Roller et al. ..... 392/467
4,436,983 A * 3/1984 Solobay ..... 392/490
4,455,475 A * 6/1984 Giorgetti ..... 392/494
4,567,350 A * 1/1986 Todd Jr. ..... 392/486
4,965,436 A * 10/1990 Churchill ..... 219/544
5,216,743 A * 6/1993 Seitz ..... 392/490
5,325,822 A * 7/1994 Fernandez ..... 392/491
5,371,830 A * 12/1994 Wachenheim ..... 392/487
5,396,574 A * 3/1995 Base et al. ..... 392/489
5,408,578 A * 4/1995 Bolivar ..... 392/490
5,482,685 A * 1/1996 Fujita et al. ..... 422/174
5,740,315 A * 4/1998 Onishi et al. ..... 392/489
5,872,890 A * 2/1999 LaCombe ..... 392/487
6,043,455 A * 3/2000 Kurita ..... 219/213
6,080,971 A * 6/2000 Seitz et al. ..... 219/483

(Continued)

*Primary Examiner* — Tu B Hoang
*Assistant Examiner* — Jimmy Chou
(74) *Attorney, Agent, or Firm* — Bracewell & Guiliani LLP

(57) ABSTRACT

An electrical heater has first and second heater elements, each having a hairpin-shaped metal tube with an upstream and a downstream leg and tube ends adjacent each other. An electrical resistance wire surrounded by insulation powder extends through the tube. Electrical terminals join to the wire and protrude from each of the tube ends. Conduits enclose the upstream and the downstream legs of the heater elements, providing a continuous annular flow path. A manifold has heater element passages for end portion of the legs. An inlet passage in the manifold leads from an exterior portion of the manifold to the annular flow path surrounding the upstream leg of the first heater element. A transfer passage within the manifold leads from the annular flow path surrounding the downstream leg of the first heater element to the annular flow path surrounding the upstream leg of the second heater element.

17 Claims, 3 Drawing Sheets

(56) References Cited

U.S. PATENT DOCUMENTS

| | | | | |
|---|---|---|---|---|
| 6,205,292 | B1 * | 3/2001 | Pokorny et al. | 392/489 |
| 6,389,226 | B1 * | 5/2002 | Neale et al. | 392/485 |
| 6,445,880 | B1 * | 9/2002 | Hollander et al. | 392/485 |
| 7,012,226 | B1 * | 3/2006 | George | 219/544 |
| 7,039,305 | B1 * | 5/2006 | Chen | 392/490 |
| 7,164,851 | B2 * | 1/2007 | Sturm et al. | 392/463 |
| 7,190,894 | B2 * | 3/2007 | Chamberlain, Jr. | 392/490 |
| 7,206,506 | B2 * | 4/2007 | Sturm | 392/478 |
| 7,477,836 | B2 * | 1/2009 | White, III | 392/465 |
| 7,496,285 | B2 * | 2/2009 | Molavi | 392/486 |
| 7,554,064 | B1 * | 6/2009 | Fannin et al. | 219/544 |
| 7,565,065 | B2 * | 7/2009 | Kato | 392/311 |
| 7,822,326 | B2 * | 10/2010 | Commette et al. | 392/484 |
| 8,150,246 | B1 * | 4/2012 | Bolivar | 392/485 |
| 8,744,252 | B1 * | 6/2014 | Snyder et al. | 392/482 |
| 2004/0146289 | A1 * | 7/2004 | Sakamoto et al. | 392/465 |
| 2010/0303452 | A1 * | 12/2010 | Olver et al. | 392/407 |

* cited by examiner

Fig. 2
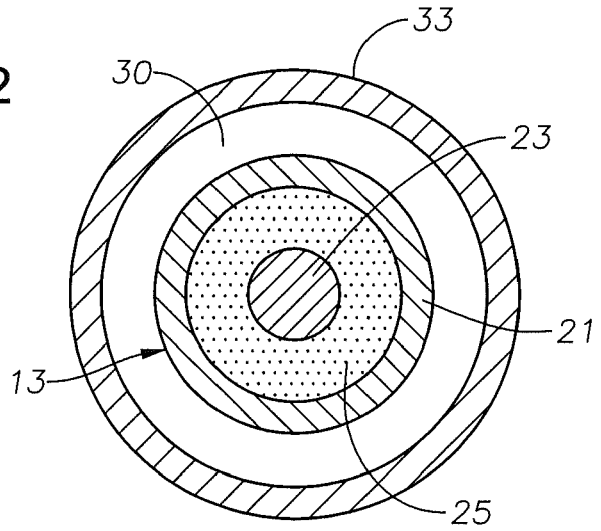
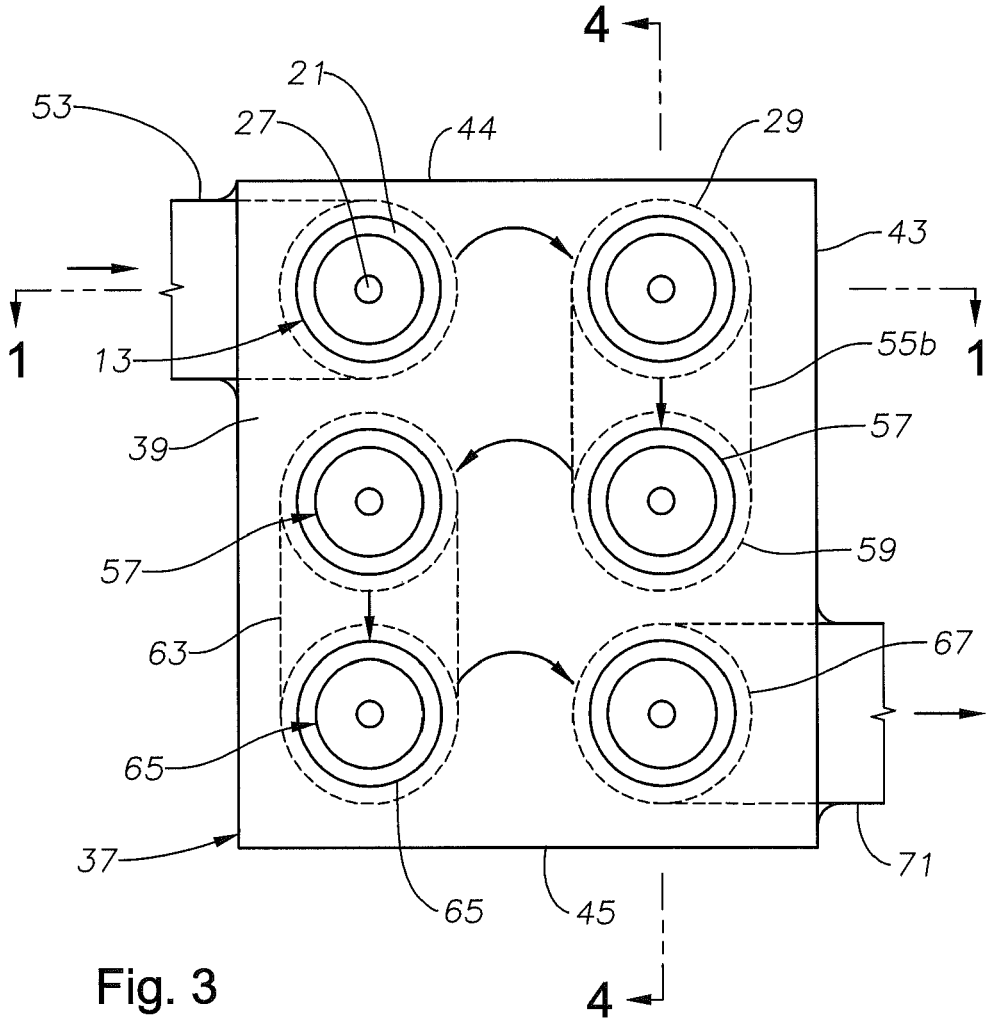
Fig. 3

Fig. 4
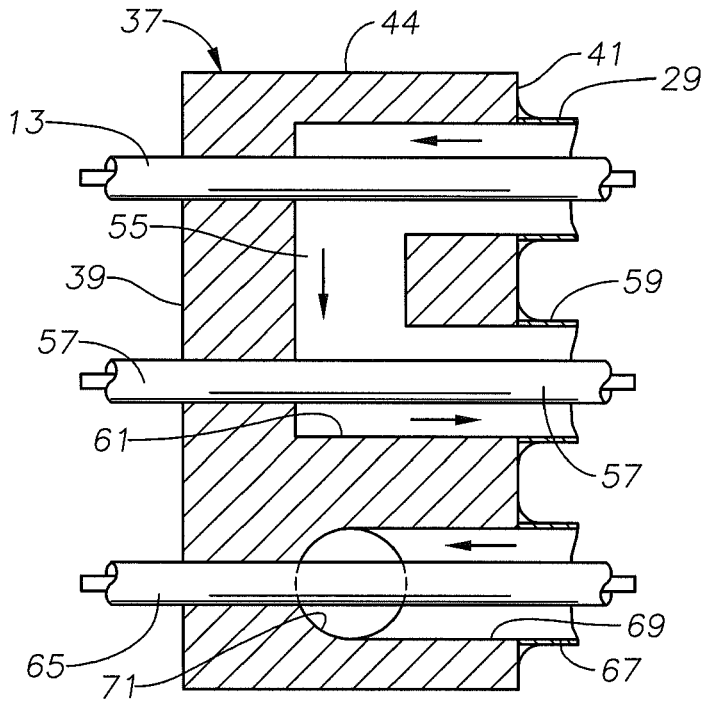
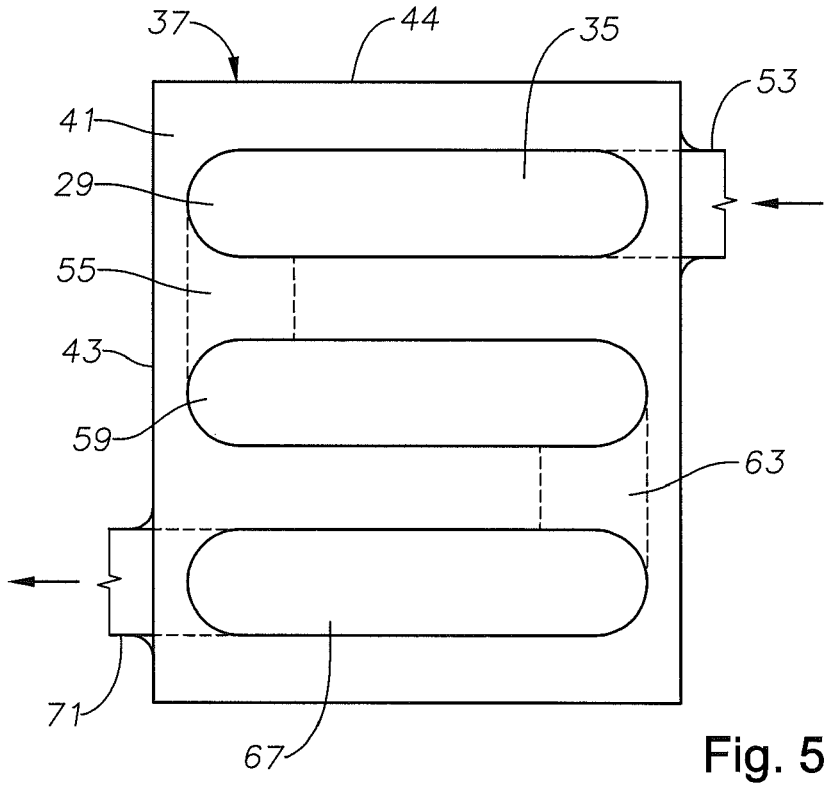
Fig. 5

HIGH VELOCITY FLUID FLOW ELECTRIC HEATER

FIELD OF THE DISCLOSURE

This application relates to electrical heaters for heating fluids in process applications, and in particular to electrical heaters for applying a high temperature increase to fluids flowing at a low flow rate.

BACKGROUND OF THE DISCLOSURE

One type of heating device used in various industries comprises a heat exchanger housing having an inlet and an outlet for the liquid to flow through. A heater element bundle is mounted in the housing. The heater element bundle has a number of electrical resistance heater elements. Each heater element includes a metal tube, an electrical resistance coil within the tube and embedded in an insulation powder, and an exterior conductor pin secured to the end of the coil. The heater has at least one end located outside of the housing, that end having a header to which each tube is secured. The opposite end may also include a header or the tubes may be hairpin-shaped.

Voltage is applied to the conductor pins to create heat in the electrical resistance coils. The fluid flows over and through the bundle of heater elements and is heated as a result. Depending on the application, the quantity of fluid flowing through the housing may be fairly low. Also, the increase in temperature required may be quite high, such as 300 to 1200 degrees F. While these heaters work well, it would be desirable to improve the efficiency of electric heaters for high temperature increases of low flow rate fluids.

SUMMARY

An electrical heater has first and second heater elements, each having a metal tube bent into a U-shape to define an upstream and a downstream leg and tube ends of the tube adjacent each other. An electrical resistance wire extends through the tube and an insulation powder surrounds the wire within the tube. An electrical terminal joins each end of the wire and protrudes from each of the tube ends. A first conduit encloses the upstream and the downstream legs of the first heater element and has a larger inner diameter than an outer diameter of the first heater element to provide a continuous annular flow path. A second conduct encloses the upstream and downstream legs of the second heater element and has a larger inner diameter than an outer diameter of the second heater element to provide a continuous annular flow path. A manifold has a front, a back, and a plurality of heater element passages extending from the front to the back. An end portion of each of the legs of the first and second heater elements is inserted from the back into one of the heater element passages such that each of the terminals protrudes out from the front for connection to electrical power. An inlet passage in the manifold leads from an exterior portion of the manifold to the annular flow path surrounding the upstream leg of the first heater element. A transfer passage within the manifold leads from the annular flow path surrounding the downstream leg of the first heater element to the annular flow path surrounding the upstream leg of the second heater element. Fluid is first heated in the annular flow path surrounding the first heater element, then in the annular flow path surrounding the second heater element.

An outlet passage in the manifold is in fluid communication with the annular flow path surrounding the second heater element for discharging fluid from the manifold. Preferably, the first and second conduits are parallel with each other. In the preferred embodiment, the manifold has a side wall joining the front and the back. The inlet passage leads from the side wall to the annular flow path surrounding the upstream leg of the first heater element. The inlet passage may be in the configuration of an elbow. The manifold has another side wall joining the front and the back. The outlet passage extends out the other side wall.

The downstream leg of the first heater element is closer to the upstream leg of the second heater element than to the downstream leg of the second heater element. A plane passing through the terminals of the first heater element is parallel with a plane passing through the terminals of the second heater element.

Each of the conduits may have an upstream pipe portion spaced apart and parallel with a downstream pipe portion. The upstream and downstream pipe portions are joined by a base portion.

BRIEF DESCRIPTION OF THE DRAWINGS

FIG. 2 is a sectional view of the heater of FIG. 1 taken along the line 2-2 of FIG. 1.

FIG. 3 is a front view of the heater of FIG. 1.

FIG. 4 is a sectional view of the heater of FIG. 1, taken along the line 4-4 of FIG. 3.

FIG. 5 is a back view of the heater of FIG. 1.

DETAILED DESCRIPTION

Figure 1:
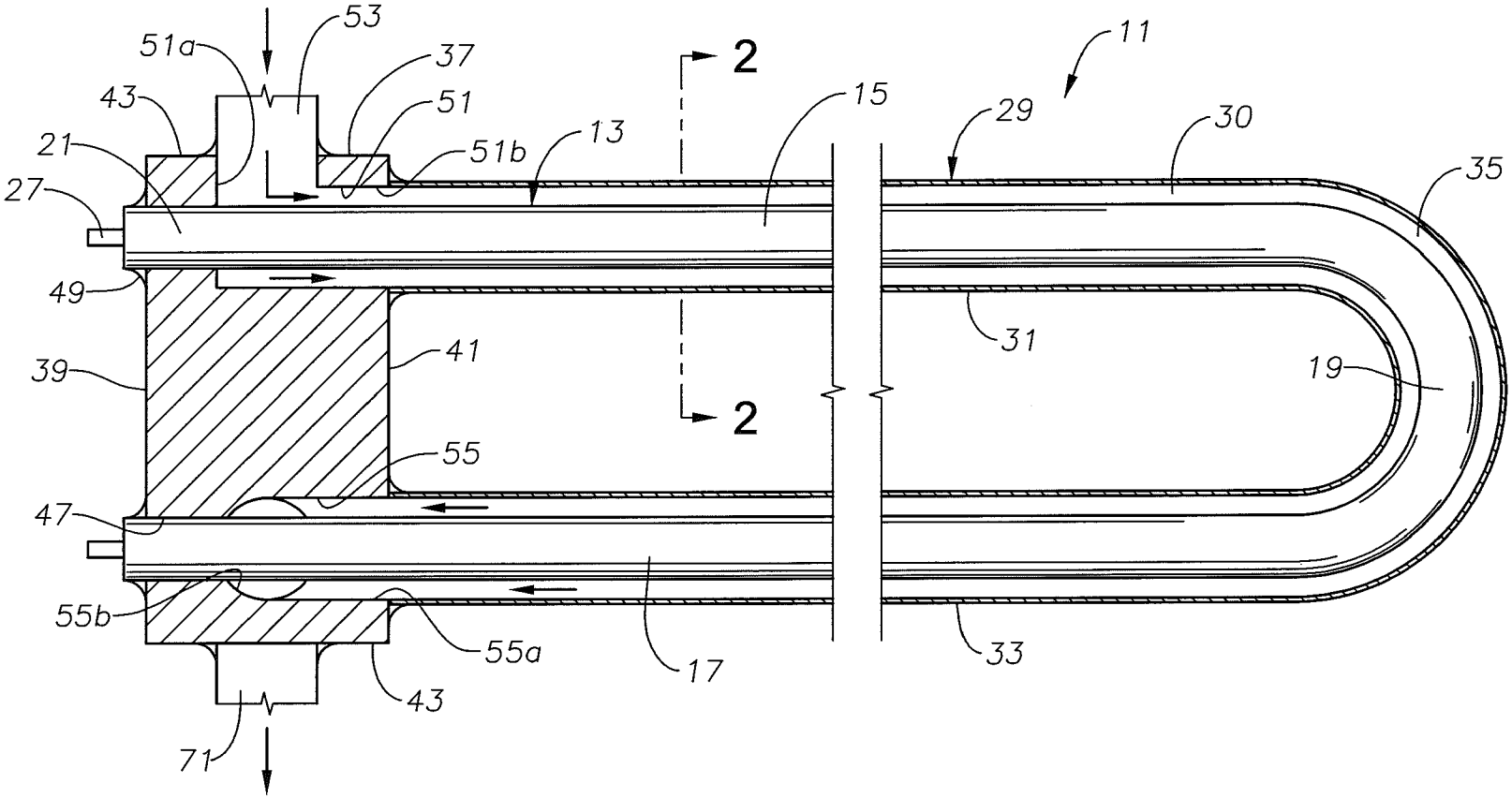
FIG. 1 is a sectional view of an electrical heater in accordance with this disclosure and taken along the line 1-1 of FIG. 3.

Referring to FIG. 1, heater 11 has a first heater element 13 that is in a U-shape or hairpin configuration. Heater element 13 has an upstream leg 15 and a downstream leg 17 that are parallel with each other and joined by a curved base 19.

As shown in FIG. 2, first heater element 13 comprises a metal tube 21 containing an electrical resistance wire 23. Wire 23 is wound in a coil and is typically formed of a nickel-chromium alloy. An electrical insulating powder 25 is packed around wire 23 within tube 21 and electrically insulates wire 23 from tube 21. Insulation powder 25 is typically magnesium oxide.

Referring back to FIG. 1, a conductor pin or terminal 27 protrudes from each open end of tube 21 for connection to an electrical power source. Terminal 27 may be a male or female electrical connector.

A conduit 29 houses base 19 and most of the length of heater element legs 15, 17. Conduit 29 may be of metal or other suitable material. Conduit 29 comprises a pipe or assembly of pipes having an inner diameter greater than an outer diameter of heater element legs 15, 17 and base 19, defining a continuous annular passage 30. Conduit 29 has an upstream leg portion 31 that encloses most of the length of heater upstream leg 15. Conduit 29 has a downstream leg portion 33 that encloses most of the length of heater downstream leg 17. A conduit base portion 35 joins leg portions 31, 33. Although shown schematically as being integral with leg portions 31, 33, conduit base portion 35 would like be a separate pipe member secured to leg portions 31, 33. Conduit base portion 35 need not be curved as illustrated, but could be a straight pipe perpendicular to conduit leg portions 31, 33. The flow areas of annular passage 30 within upstream leg portion 31 and downstream leg portion 33 are preferably constant and the same. The flow area in the portion of annular passage 30 in base portion 35 optionally may change in places and may differ from the constant flow area in upstream and downstream leg portions 31, 33.

First heater element 13 and conduit 29 are joined to a manifold 37 opposite base 19 and base portion 35. Manifold 37 is a block, preferably of metal, and is illustrated as being rectangular, but it may have other shapes. In this example, manifold 37 has a front 39 and a back 41 that face in opposite directions and are joined by four side walls 43. Referring to FIG. 3, one of the side walls 43 may be considered to be a top 44 and the other a bottom 45. The terms "front", "back", "top", and "bottom" are used merely for convenience as heater 11 may be installed in various orientations.

Referring again to FIG. 1, two parallel end portion passages 47 extend from front 39 to back 41. A forward portion of heater element upstream leg 15 extends through one of the end portion passages 47. A forward portion of heater element downstream leg 17 extends through the other of the end portion passages 47. The ends of metal tube 21 protrude slightly past front 39 in this example, and may be welded to front 39 as indicated by weld 49.

An inlet passage 51 has an inlet portion 51*a* extending into manifold 37 from one of the side walls 43. Inlet passage 51 has an outlet portion 51*b* that extends to back 41 and joins inlet portion 51*a*, creating an elbow shape. Outlet portion 51*b* is of larger diameter than and concentric with end portion passage 47. End portion passage 47 joins outlet portion 51*b* at the intersection with inlet portion 51*a*. The junction of end portion passage 47 with outlet portion 51*b* is about halfway between front 39 and back 41. An inlet line 53 is secured to inlet portion 51*a*. The open end of conduit upstream leg portion 31 is secured to outlet portion 51*b* at back 41, such as by welding.

A first transfer passage 55 extends into back 41 in axial alignment with the other end passage portion 47. Transfer passage 55 has an inlet portion 55*a* and an outlet portion 55*b* that may be perpendicular to inlet portion 55*a*, defining an elbow shape. In this example, outlet portion 55*b* extends downward relative to top 44, as illustrated in FIG. 3. Transfer passage 55 has a larger diameter that the end passage portion 47 joining it. The junction of end passage portion 47 with transfer passage 55 is about halfway between front 39 and back 41. The open end of downstream leg portion 33 of conduit 29 joins transfer passage outlet 55*b*, as by welding.

Referring to FIG. 3 first transfer passage outlet 55*b* leads to a second heater element 57 located within a second conduit 59. Transfer passage outlet 55*b* joins a second conduit inlet passage 61, as shown also in FIGS. 4 and 5. Second heater element 57 and second conduit 59 are constructed the same as first heater element 13 and first conduit 29. The fluid flows through the annular passage of second conduit 59 to a second transfer passage 63. Second transfer passage 63 is constructed the same as first transfer passage 55. Second transfer passage 63 communicates the fluid to the annular passage surrounding a third heater element 65 within a third conduit 67. Third heater element 65 and third conduit 67 are constructed to the same as first heater element 13 and first conduit 29. The downstream leg portion of third conduit 67 has an outlet 69 that joins an outlet passage 71, as shown in FIG. 4. Outlet passage 71 is elbow shaped in the same manner as inlet passage 55 (FIG. 1) and leads to a side 43 opposite the side 43 in which inlet passage 55 extends.

In operation, referring to FIG. 1, fluid is supplied through inlet line 53 and electrical power is applied to terminals 27. The fluid is heated to a first temperature as it flows through annular passage 30 between first electrical heater element 13 and first conduit 29. The fluid then flows through first transfer passage 55 to an annular passage between a second heater element 57 within a second conduit 59, as shown in FIGS. 3-5. Second heater element 57 heats the fluid to a second temperature level. From the second conduit 59, the fluid flows through second transfer passage 63 to third conduit 67. Third heater element 65 heats the fluid to a third temperature, and the fluid is discharged out outlet 71. The fluid thus flows in series past each heater element 13, 57 and 65. The cumulative temperature increase is typically in the range from 300 to 1200 degrees F.

More or fewer heater elements than three could be employed. In this embodiment, as shown in FIG. 3, a plane passing through terminals 27 of first heater element 13 is parallel to planes passing through the terminals of second and third heater elements 57, 65. The end of downstream leg portion 33 of first conduit 29 is spaced closer to the end of upstream leg portion 31 of second conduit 59 than to the end of downstream leg portion 33 of second conduit 59. Similarly, the end of downstream leg portion 33 of second conduit 59 is spaced closer to the end of upstream leg portion 31 of third conduit 67 than to the end of downstream leg portion 33 of third conduit 67.

The annular passage 30 through conduits 29, 59 and 67 is sized to increase the velocity of the fluid flowing through. The cross-sectional flow area of inlet line 53 is preferably larger than the cross-sectional flow areas within the annular passages 30, particularly in the upstream and downstream leg portions 31, 33. The cross-sectional areas of annular passages 30 will be sized to meet particular applications. A higher velocity through annular passages 30 creates turbulence, which enhances heat transfer.

While the disclosure has been shown in only one of its forms, it should be apparent to those skilled in the art that it is not so limited but is susceptible to various changes without departing from the scope of the disclosure.

The invention claimed is:

1. An electrical heater, comprising:

first and second heater elements, each having a U-shape metal tube to define an upstream and a downstream leg and tube ends of the tube adjacent each other, an electrical resistance wire extending through the tube, an insulation powder surrounding the wire within the tube, and an electrical terminal joined to the wire and protruding from each of the tube ends;

a first conduit enclosing the upstream and the downstream legs of the first heater element and having a larger inner diameter than an outer diameter of the first heater element to provide a continuous annular flow path;

a second conduct enclosing the upstream and downstream legs of the second heater element and having a larger inner diameter than an outer diameter of the second heater element to provide a continuous annular flow path;

a manifold having a front, a back, and a plurality of heater element passages extending from the front to the back;

an end portion of each of the legs of the first and second heater elements being inserted from the back into one of the plurality of heater element passages such that each of the terminals protrudes out from the front for connection to electrical power;

an inlet passage in the manifold leading from an exterior portion of the manifold to the annular flow path surrounding the upstream leg of the first heater element; and a transfer passage within the manifold leading from the annular flow path surrounding the downstream leg of the first heater element to the annular flow path surrounding the upstream leg of the second heater element, so that fluid is first heated in the annular flow path surrounding the first heater element, then in the annular flow path surrounding the second heater element.

2. The heater according to claim 1, further comprising:

an outlet passage in the manifold in fluid communication with the annular flow path surrounding the second heater element for discharging fluid from the manifold.

3. The heater according to claim 1, wherein the first and second conduits are parallel with each other.

4. The heater according to claim 1, wherein:

the manifold has a side wall joining the front and the back; and the inlet passage leads from the side wall to the annular flow path surrounding the upstream leg of the first heater element.

5. The heater according to claim 4, wherein the inlet passage is in the configuration of an elbow.

6. The heater according to claim 4, wherein:

the manifold has another side wall joining the front and the back; and the outlet passage extends out said another side wall.

7. The heater according to claim 1, wherein:

The downstream leg of the first heater element is closer to the upstream leg of the second heater element than to the downstream leg of the second heater element.

8. The heater according to claim 1, wherein:

a plane passing through the terminals of the first heater element is parallel with a plane passing through the terminals of the second heater element.

9. The heater according to claim 1, wherein:

the first conduit comprises an upstream pipe portion spaced apart and parallel with a downstream pipe portion, the upstream and downstream pipe portions being joined by a base portion; and the second conduit comprises an upstream pipe portion spaced apart and parallel with a downstream pipe portion, the upstream and downstream pipe portions being joined by a base portion.

10. An electrical heater, comprising:

a plurality of heater elements, each having a U-shape metal tube with parallel upstream and downstream legs joined by a base and with tube ends opposite the base, an electrical resistance wire extending through the tube, an insulation powder surrounding the wire within the tube, and an electrical terminal joined to the wire and protruding from each of the tube ends;

a plurality of conduits, each having parallel upstream and downstream leg portions joined by a base portion, each of the upstream leg portions having an outlet and each of the downstream leg portions having an inlet, the inlet and the outlet being opposite the base portion;

each of the heater elements being located within one of the conduits with end portions of each of the heater elements protruding from the inlet and the outlet of each of the conduits, each of the heater elements having an outer diameter smaller than an inner diameter of each of the conduits, defining an annulus flow path;

a manifold having a front, a back, and a plurality of heater element passages extending from the front to the back;

the end portions of each of the heater elements being located within the heater element passages with each of the terminals protruding out from the front for connection to electrical power;

an inlet passage leading into the manifold to the annular flow path surrounding the upstream leg of a first one of the heater elements;

at least one transfer passage within the manifold leading from the annular flow path surrounding the downstream leg of the first one of the heater elements to the annular flow path surrounding the upstream leg of a second one of the heater elements; and an outlet passage leading out of the manifold from the annular flow path surrounding the downstream leg of a last one of the heater elements.

11. The heater according to claim 10, wherein said at least one transfer passages comprises first and second transfer passages, with the second transfer passage leading from the annular flow path surrounding the downstream leg of the second one of the heater elements to the upstream leg of the last one of the heater elements.

12. The heater according to claim 10, wherein:

the manifold has two side walls joining the front and the back; and the inlet passage leads from one of the side walls to the annular flow path surrounding the upstream leg of the first one of the heater elements; and the outlet passage extends out from the other of the side walls.

13. The heater according to claim 12, wherein the side walls face in opposite directions.

14. The heater according to claim 10, wherein:

a plane passing through the terminals of the first one of the heater elements is parallel with a plane passing through the terminals of the second one of the heater elements and with a plane passing through the terminals of the last one of the heater elements.

15. The heater according to claim 1, wherein:

the downstream leg of the first one of the heater elements is closer to the upstream leg of the second one of the heater elements than to the upstream leg of the second one of the heater elements; and the downstream leg of the second one of the heater elements is closer to the upstream leg of the last one of the heater elements than to the upstream leg of the last one of the heater elements.

16. The heater according to claim 10, further comprising:

a plurality of conduit inlet ports extending into the back of the manifold;

a plurality conduit outlet ports extending into the back of the manifold;

the inlet of each of the conduits is sealed to one of the inlet ports; and wherein the outlet of each of the conduits is sealed to one of the outlet ports.

17. The heater according to claim 16, wherein the first transfer passage extends within the manifold from one of the outlet ports to one of the inlet ports.

* * * * *